US007619215B2

(12) United States Patent
Kim

(10) Patent No.: US 7,619,215 B2
(45) Date of Patent: Nov. 17, 2009

(54) SAMPLE PLATE FOR MALDI MASS SPECTROMETRY AND PROCESS FOR MANUFACTURE OF THE SAME

(76) Inventor: Yangsun Kim, Seoul Green Villa 1-301, 146, Gumi-dong, Bundang-gu, Seongnam-si, Gyeonggi-do (KR)

( * ) Notice: Subject to any disclaimer, the term of this patent is extended or adjusted under 35 U.S.C. 154(b) by 239 days.

(21) Appl. No.: 11/498,557

(22) Filed: Aug. 3, 2006

(65) Prior Publication Data

US 2007/0075241 A1 Apr. 5, 2007

Related U.S. Application Data

(63) Continuation-in-part of application No. PCT/KR2006/000445, filed on Feb. 7, 2006.

(30) Foreign Application Priority Data

Feb. 7, 2005 (KR) ..... 10-2005-0011174
Dec. 15, 2005 (KR) ..... 10-2005-0123970

(51) Int. Cl.
*H01J 49/04* (2006.01)

(52) U.S. Cl. ..... 250/288; 422/50; 436/174

(58) Field of Classification Search ..... None
See application file for complete search history.

(56) References Cited

U.S. PATENT DOCUMENTS 5,863,650 A * 1/1999 Healy et al. ..... 428/336
6,287,872 B1 * 9/2001 Schurenberg et al. ..... 436/181
6,670,609 B2 * 12/2003 Franzen et al. ..... 250/288
6,737,024 B1 * 5/2004 Eipel et al. ..... 422/101
6,822,230 B2 * 11/2004 Schleifer et al. ..... 250/288
6,825,465 B2 11/2004 Schürenberg ..... 250/288
6,825,478 B1 * 11/2004 McCarthy et al. ..... 250/440.11
6,902,869 B2 * 6/2005 Appelt et al. ..... 430/311
6,952,011 B2 10/2005 Brown et al. ..... 250/288
7,291,284 B2 * 11/2007 Mirkin et al. ..... 216/41
2004/0241896 A1 * 12/2004 Zhou et al. ..... 438/48
2005/0164402 A1 * 7/2005 Belisle et al. ..... 436/174
2005/0272268 A1 * 12/2005 Hwang et al. ..... 438/745
2006/0216853 A1 * 9/2006 Nomoto ..... 438/99
2006/0222815 A1 * 10/2006 Oles et al. ..... 428/145

FOREIGN PATENT DOCUMENTS

DE 19705910 6/1998
DE 19923761 2/2001
EP 1284495 2/2003
EP 1364702 11/2003
JP 2004-184137 7/2004

OTHER PUBLICATIONS

International Search Report for International Application No. PCT/KR2006/000445; International Filing Date Feb. 7, 2006; Date of Mailing May 23, 2006.

* cited by examiner

*Primary Examiner*—Jack I Berman
(74) *Attorney, Agent, or Firm*—Cantor Colburn LLP

(57) ABSTRACT

The present invention relates to a sample microfocusing plate useful in MALDI mass spectrometry having a patterned hydrophobic organosilane coating layer and at least a central portion formed on the surface and a process for manufacturing and using the sample microfocusing plate. The sample microfocusing plate can rapidly dry the solvent contained in samples leading to efficient sample analysis, and can be prepared by cost effectiveness.

18 Claims, 20 Drawing Sheets

Bruker type

ABI type

Amersham type water diluted color ink 72.48°

Stainless Steel
Bare 53.22°

Clean Surface

Anchorchip plate

Sample microfocusing plate

SAMPLE PLATE FOR MALDI MASS SPECTROMETRY AND PROCESS FOR MANUFACTURE OF THE SAME

CROSS REFERENCE TO RELATED APPLICATIONS

This application is a continuation-in-part application of a PCT Intentional Application, PCT/KR 2006/000445, filed in Feb. 7, 2006, which claims priority to and the benefit of Korean Application No. 10-200500011174 filed on Feb. 7, 2005, and Korean Application No. 10-2005-0123970 filed on Dec. 15, 2005, in the Korean Patent Office, the entire contents of which are incorporated hereinto by reference.

FIELD OF THE INVENTION

The present invention relates to a sample plate useful in matrix-assisted laser desorption ionization (MALDI) mass spectrometry and a process for manufacturing and using the sample plate. More particularly, the present invention relates to a sample plate useful in MALDI mass spectrometry having a patterned hydrophobic organosilane coating layer and at least a central portion formed on the surface and a process for manufacturing and using the sample plate.

BACKGROUND OF THE INVENTION

For the analysis of large molecules such as DNA, peptides, proteins and other biomolecules, mass spectrometry with MALDI is a standard method. For the most part, time-of-flight mass spectrometers (TOF-MS) are used for this purpose, but ion cyclotron resonance (ICR) spectrometers or Fourier transform ion cyclotron resonance (FT-ICR) mass spectrometers as well as high-frequency quadrupole ion trap mass spectrometers, and hybrid quadrupole time of flight (Q-TOF) mass spectrometers are all applicable for these applications. Normally, biomolecules are in an aqueous solution, but is not uncommon for these important building blocks to be dissolved in solutions that contain varying levels of organic solvents (such as acetonitrile), particularly when reversed phase chromatography is used for isolation and fractionation of complex mixtures of these molecules.

In MALDI mass spectrometry, analyte is mixed with a matrix solution and deposited on a MALDI sample plate for subsequent drying and crystallization. In the drying process, crystal growth of the matrix is induced and analyte molecules become co-crystallized with the matrix. The MALDI sample plate is then inserted into a mass spectrometer and laser beam is directed to the sample plate. Photon bombardment causes the matrix and the analyte to be desorbed and ionized without substantially fragmenting the analyte. The desorbed ions are then mass analyzed in the mass spectrometer. The matrix is an energy absorbing substance which absorbs energy from the laser beam thereby enabling analyte to desorb from the sample plate.

Various methods are known for applying the sample and matrix to a sample plate. The simplest method of these involves a step of pipetting a solution containing analyte and matrix in a droplet onto a metal (e.g., stainless steel) sample support plate. This droplet wets an area on the metal surface, the size of which corresponds approximately to the diameter of the droplet and is dependent on the hydrophobic properties of the metal surface and the characteristics of the droplet. After the solution dries, the sample spot consists of small matrix crystals spread over the formerly wet area, whereby generally there is no uniform coating of the previously wetted area. In aqueous solutions, most of the small crystals of the matrix generally begin to grow at the periphery of the wetted area on the metal plate, growing toward the inside of the wetted area.

It is known that specimens are non-homogeneously distributed on and/or within the lattice that located at the specimen periphery. It is further known that some of these matrix crystals bear more biomolecules than others. Thus, as the laser covers a search area at the specimen periphery, it scans "sweet spots" having a comparatively higher specimen concentration in the matrices.

MALDI-MS performance suffers chiefly from analysis insensitivity. The sample plates that are used in MALDI-MS are typically metallic plates due to the need to apply a voltage across the plate. Stainless steel plates are the most widely used trays because of its chemical stability and proper work function for ionization. However, these give a smooth hydrophilic surface where the applied specimen drop spreads over a relatively large area before drying and forming crystals.

To solve this problem, a stainless steel plate coated with a 30-40 μm thick layer of hydrophobic polytetrafluoroethylene (also known as "PTFE" or Teflon (RTM)) with 200-800 μm diameter hydrophilic spots on it has been provided in U.S. Pat. No. 6,287,872 and U.S. Pat. No. 6,952,011 for focusing sample and matrix.

However, another drawback of metallic plates is that they unfortunately often provide unsuitable results due to unintentional contamination with detergents. Since existing metallic sample plates are also expensive, they are used repeatedly. Washing between each use may contaminate the sample plate used for subsequent analysis.

Therefore it is desirable if there is a sample plate wherein the crystal of sample and matrix are located on the sampling spot.

Also, sample plate which can be used in a disposable type or sample-keeping type is required in considering the cost effectiveness.

A metal substrate coated with a conductive polymer or gold has been suggested as a disposable type sample plate in U.S. Pat. No. 6,952,011 or U.S. Pat. No. 6,825,465.

SUMMARY OF THE INVENTION

In one embodiment of the present invention, a sample plate for MALDI mass spectrometry is provided with precisely controlled dimensions for accurate sample analysis.

In another embodiment, the present invention is to provide a sample plate for MALDI-MS comprising a sample microfocusing plate and a sample support holder having a surface to accept the sample microfocusing plate, and at least a magnet to attach the sample microfocusing plate to the surface. In another embodiment, the sample support holder has protruding guides for positioning the sample microfocusing plate on the surface, which are located at a pair of two opposite sides of the surface or at two pairs of two opposite sides of the surface. The sample support holder comprises at least three sheets of electrically conductive substrate where at least a magnet is located through a hole in the internal sheet or at concaves of inner surfaces. The sample microfocusing plate slides and is positioned on the surface of the sample support holder.

In the present invention, the sample plate of the prior art is separated into the sample microfocusing plate and the sample support holder, which can be attached and detached easily. Thus, the sample microfocusing plate containing a sample can be kept easily and reused in future in a separable form from the sample support holder, and can be used as a disposable type.

In further embodiment of the present invention, a sample microfocusing plate for MALDI mass spectrometry is provided to keep a used sample for further measurement or to use as a disposable type.

In still embodiment of the present invention, a process of preparing a sample microfocusing plate for MALDI mass spectrometry is provided with low manufacturing cost and short manufacturing time due to use of photolithography instead of laser etching used in the prior art.

In one embodiment of the present invention, it is to provide a sample microfocusing plate for matrix-assisted laser desorption ionization (MALDI) mass spectrometry comprising at least one sampling area marked by chemical etching on a surface of an electrically conductive substrate, the sampling area comprising a central portion for concentrating the sample where a thin film of hydrophobic organosilane is not formed, and a peripheral portion surrounding the central portion where a thin film of hydrophobic organosilane is formed by covalent binding to the surface.

Preferably, the thin film of sample microfocusing plate in the present invention is a monolayer of hydrophobic organosilane which is at least one selected from the group consisting of alkanesilane and fluorosilanes. The thin film has a thickness of about 5 nm to about 50 nm. The central portion has a diameter ranging from 100 μm to 1 mm.

The substrate of sample microfocusing plate and sample support holder, preferably, is made of a stainless steel, aluminum, zinc, copper, silicon, or conductive polymer, and has a thickness of approximately 0.1 mm to 0.5 mm, more preferably 0.2 mm to 0.3 mm.

The marked sampling area has a circular shape, a rectangular shape, a triangle shape or grid shape.

In another embodiment of the present invention, it is to provide a method of preparing a sample microfocusing plate for matrix-assisted laser desorption ionization (MALDI) mass spectrometry comprising the steps of:

a) chemical etching a portion of a substrate exposed by a first photoresist pattern formed on the substrate; and b) forming the marked sampling area with etched boundary on the substrate by removing the first photoresist pattern.

In still embodiment of the present invention, a method of preparing a sample microfocusing plate for matrix-assisted laser desorption ionization (MALDI) mass spectrometry comprising the steps of:

a) chemical etching a portion of a substrate exposed by a first photoresist pattern formed on the substrate;

b) forming the marked sampling area with etched boundary on the substrate by removing the first photoresist pattern;

c) forming second photoresist pattern on a center portion of the surfaces of marked sampling area;

d) forming a hydrophobic coating layer on the substrate obtained in step c); and e) removing the second photoresist pattern to form the central portion uncoated with the hydrophobic coating layer.

Preferably, before step a), the surface of the substrate is cleaned and oxidized by chemical or physical treatment which is carried out by acid solution or plasma treatment.

The formation of the hydrophobic coating layer in step d) comprises the steps of uniformly and integrally coating a hydrophobic material on the substrate, the marked and second photoresist pattern; and removing the second photoresist pattern formed on the central portion and the hydrophobic material positioned on the second photoresist pattern.

The hydrophobic coating layer is a thin film of monolayered hydrophobic organosilane which is substantially uniformly and integrally formed thereon, but is not formed on the surface of the central portion to concentrate the sample. The organosilane is at least one selected from the group consisting of alkanesilane and fluorosilanes. The hydrophobic coating layer has a thickness of about 5 nm to about 50 nm, and the central portion has a diameter ranging from 100 μm to 1 mm.

The first photoresist pattern and the second photoresist pattern are formed by photolithography after photoresist coating. The first photoresist pattern and the second photoresist pattern are made from same or different material.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawing.

FIG. 1A Bruker type, 1B Applied Bio system type and 1C Amersham type.

DESCRIPTION OF SPECIFIC EMBODIMENTS

Hereinafter, the present invention is described in more detail.

The sample microfocusing plate has been made by photolithographic patterning process and chemical etching process, and direct covalent bonding of hydrophobic organosilane on surface of stainless steel thin plates.

The photolithographic patterning process is applied for SUS surfaces directly, thus various pattern drawing on the surface and mass productions with a low cost can be achieved. The covalent bonding of hydrophobic organosilane provides homogeneous surface coating on large area by simply dipping the plate into the solution in a short reaction time. Although the film thickness is thin with thickness of 5-50 nm, it is stable chemically and physically. Chemical etching process of thin SUS makes it possible to treat a large area and to produce the sample plate in a large scale.

Sample Plate

The sample plate 200 includes the sample microfocusing plate 210 and the sample support holder 220, which are separable and/or slidable so as to be attached and detached easily. Thus, the sample microfocusing plate containing a sample can be kept easily and reused in future in a separable form from the sample support holder, and can be used as a disposable one. An example of the sample plate is presented FIG. 9A.

The MALDI sample plate is composed of magnetic sample support holder and thin sample microfocusing plate. The magnetic sample support holder was fabricated from 1 mm and 2 mm thickness SUS sheets by photolithography and chemical etching. Two pieces of SUS sheets were welded to make magnetic sample support holder. Between these two sheets, magnets were inserted. The upper layer was chemically etched to the thickness of thin sample microfocusing plate to make sliding of the sample microfocusing plate possible and give perfect fit for the sample microfocusing plate.

Figure 1A:
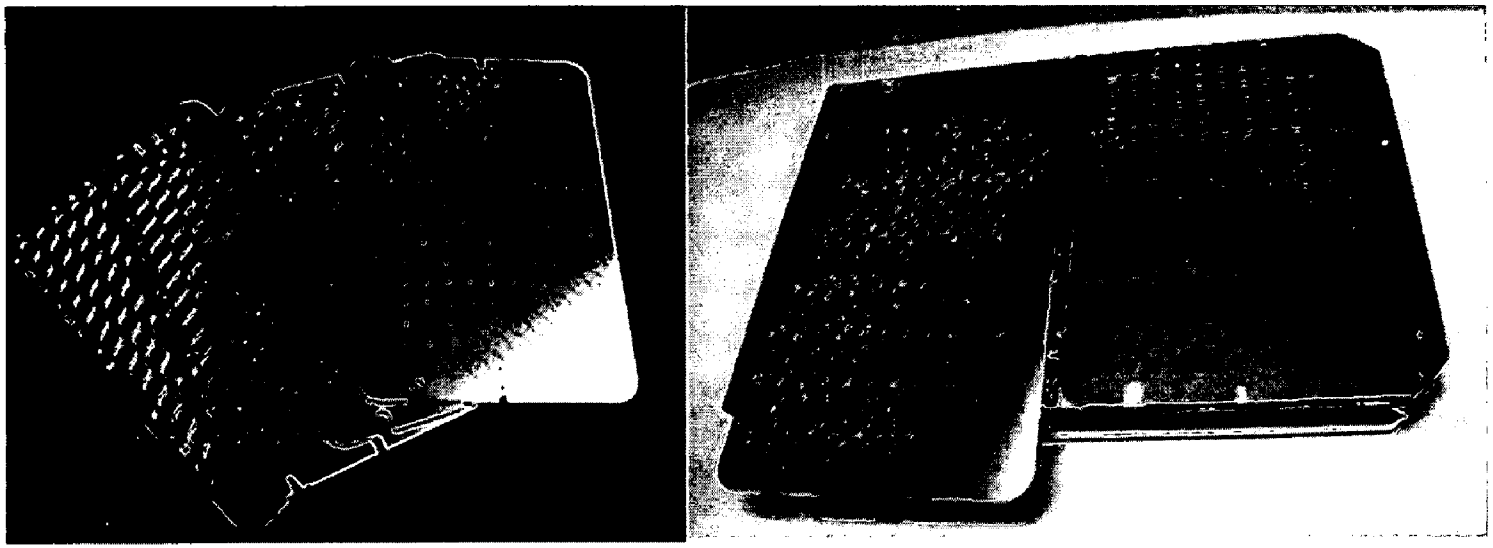
FIG. 1A to 1C are pictures of the sample microfocusing plates and sample support holders as described herein.
Figure 1B:
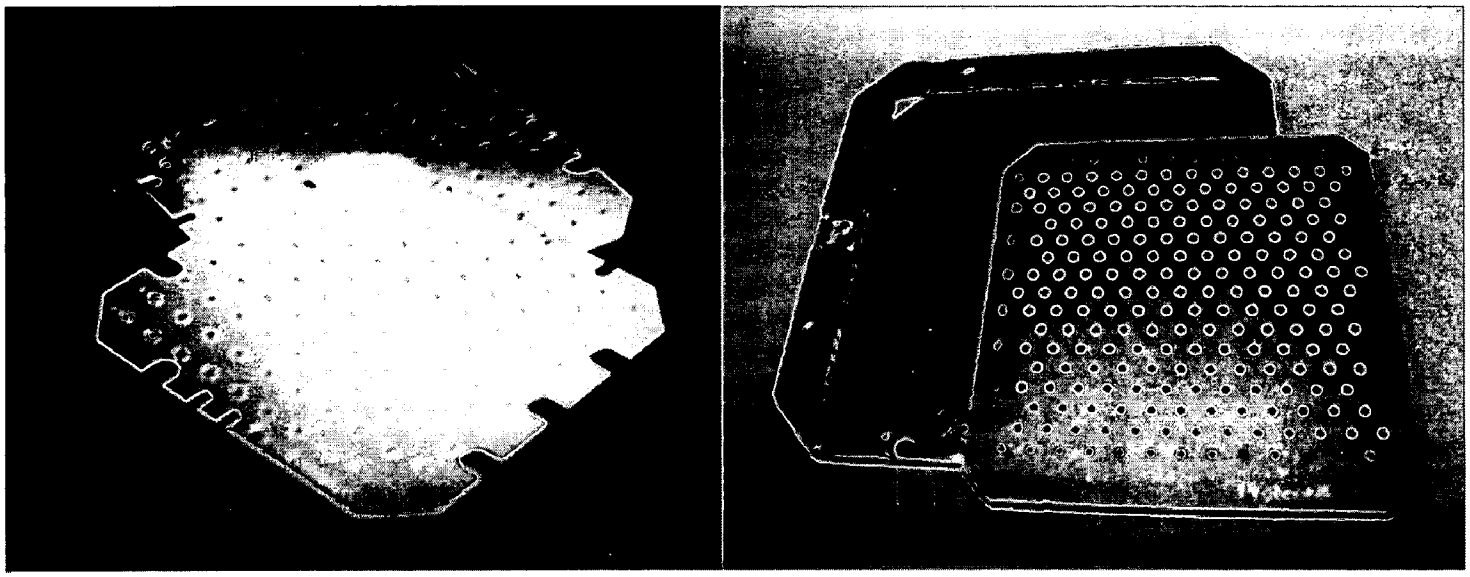
Figure 1C:
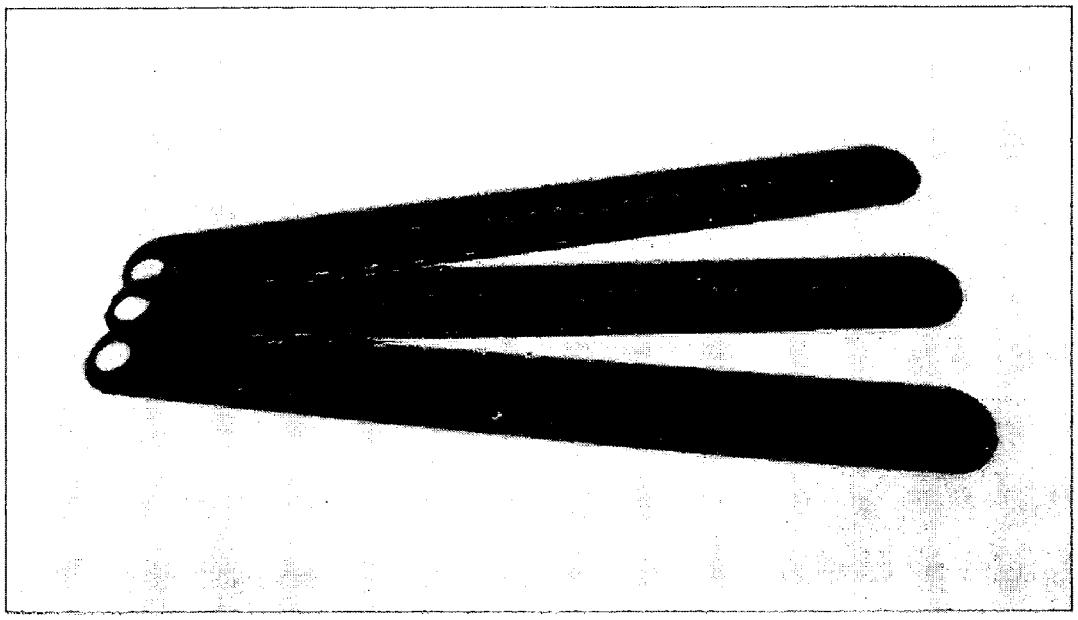

Three different designs of MALDI plates from different venders such as Bruker, ABI, and Amersham in FIGS. 1A, 1B and 1C have been made. The process includes two consecutive photolithographic processes. One is for making the marking area for sample loading or logo combined with chemical etching, and the other is for making hydrophobic and hydrophilic pattern on it using monolayer formation of organosilane coating.

Sample Microfocusing Plate

Figure 2A:
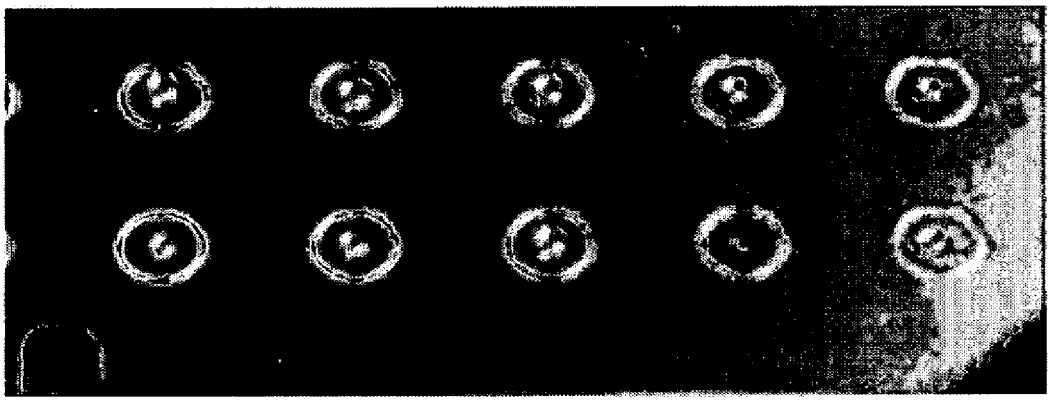
FIG. 2A and FIG. 2B are illustrations of focusing using water and diluted color ink on the sample microfocusing plates.
Figure 3A:
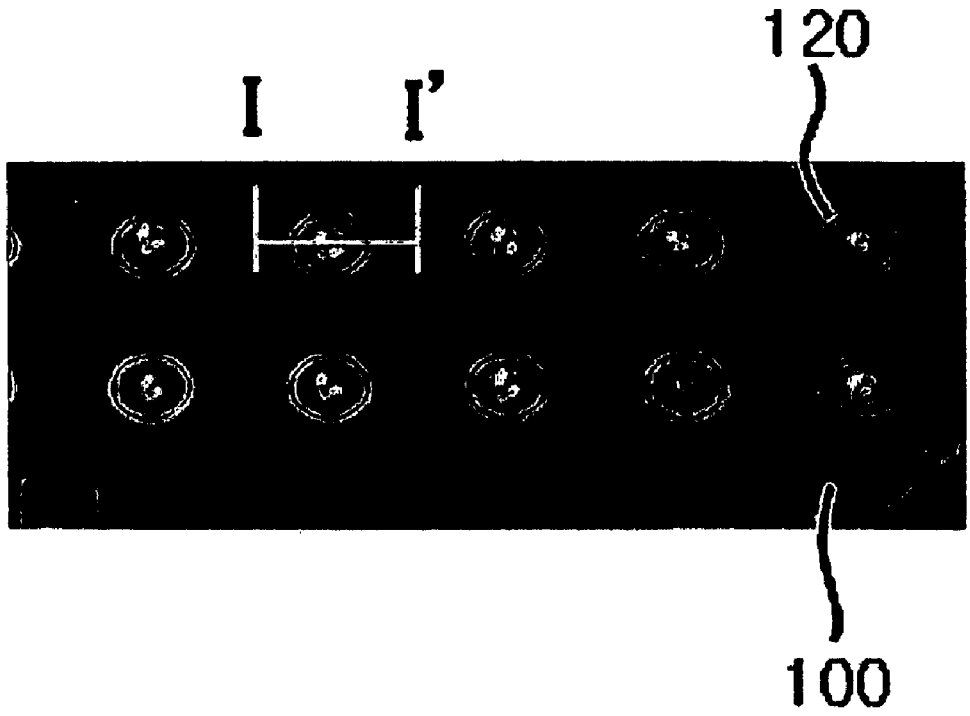
FIG. 3A is a picture of the sample microfocusing plate.
Figure 3B:
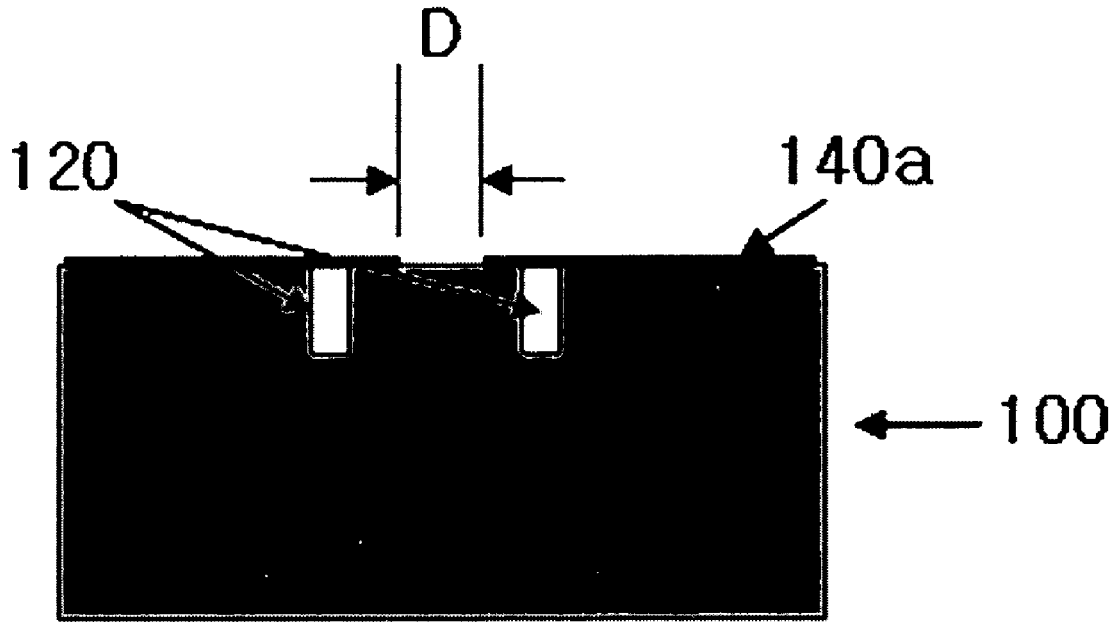
FIG. 3B is a cross-sectional view illustrating the sample microfocusing plate taken along a line of I-I' in FIG. 3A.

FIG. 2A is a perspective view illustrating the sample microfocusing plate in accordance with the description of the present invention, and FIG. 3B is a cross-sectional view illustrating the sample microfocusing plate taken along a line of I-I' in FIG. 3A.

Figure 9A:
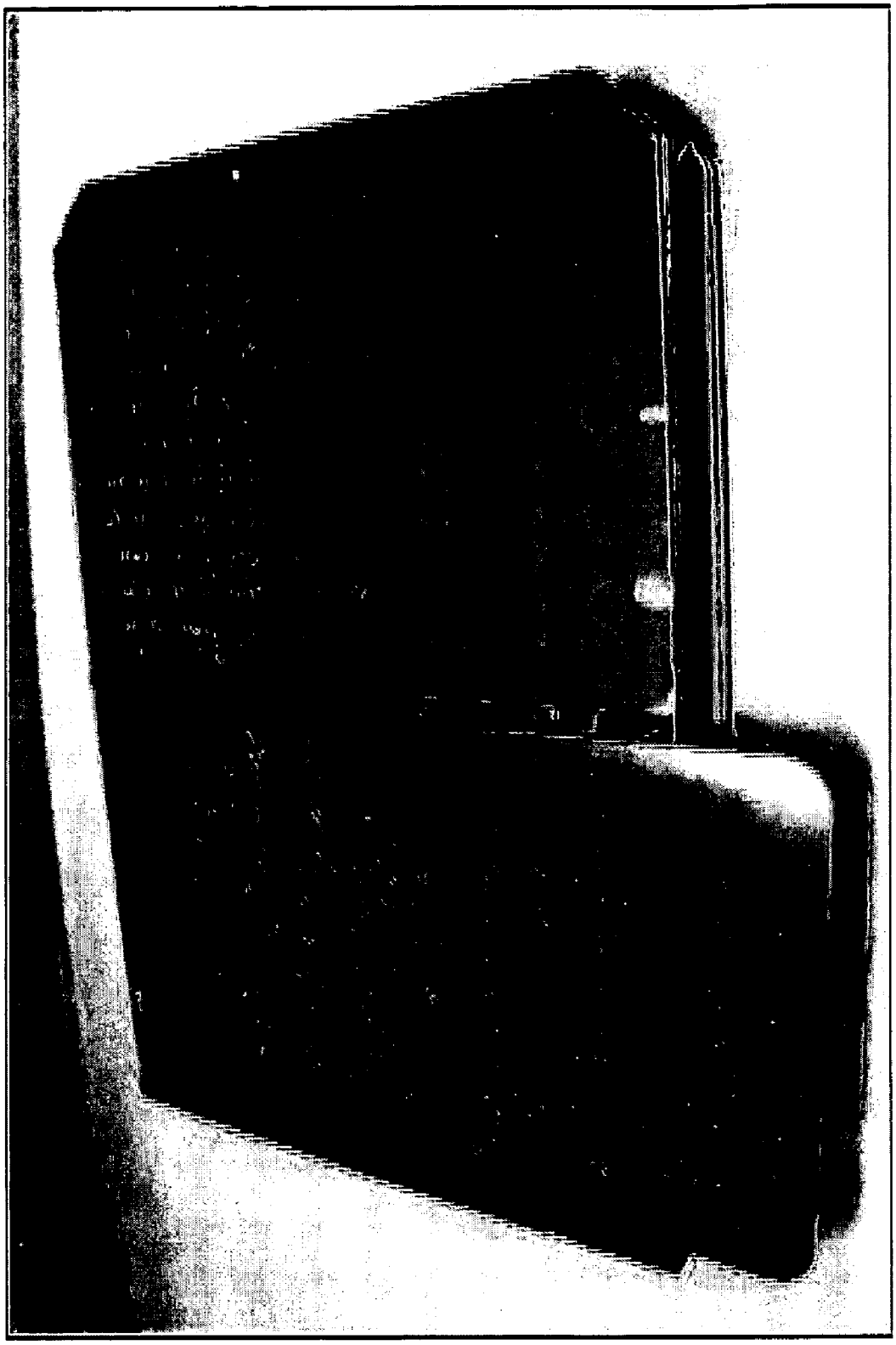
FIG. 9A to 9C are a photograph and drawing showing an embodiment of a sample plate, a sample microfocusing plate and a sample support holder.
Figure 9B:
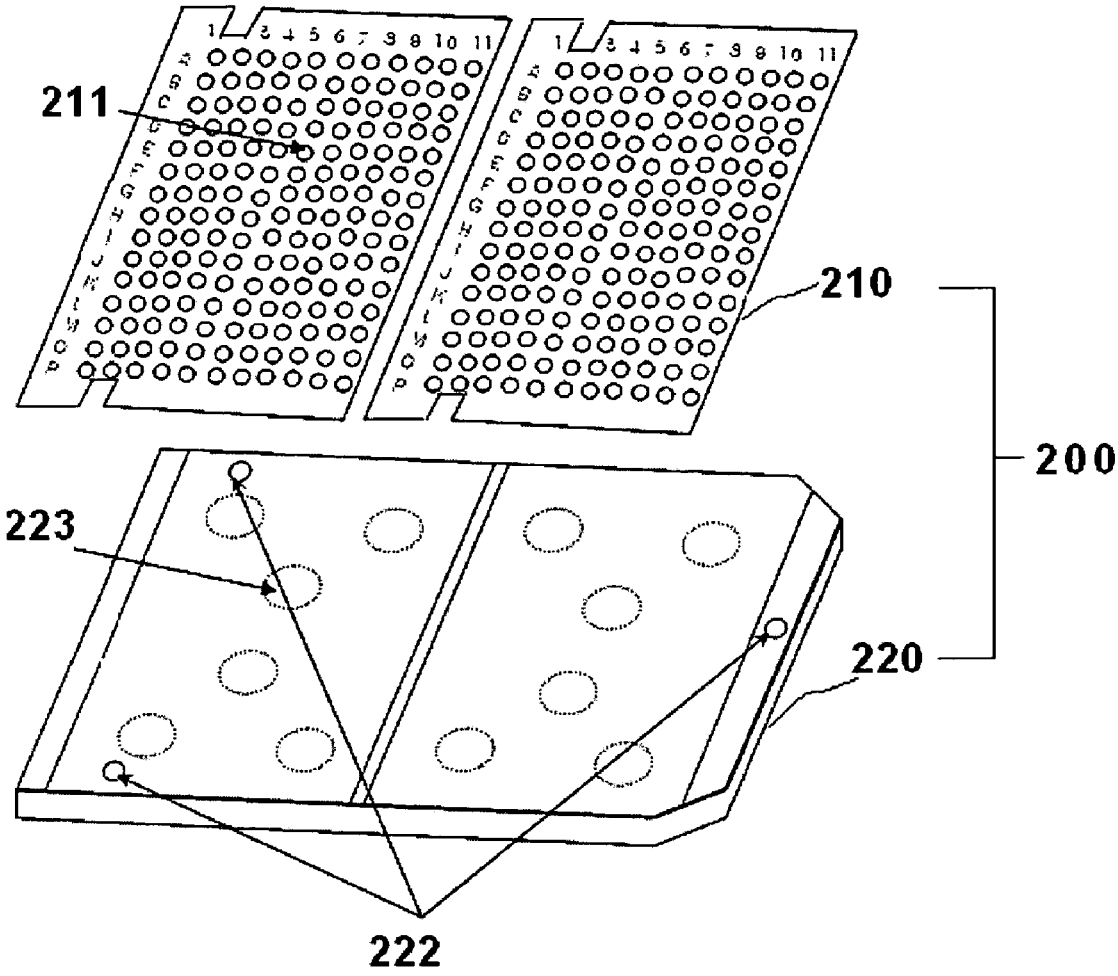

An embodiment of the sample microfocusing plate 210, is shown in FIGS. 9A and 9B, where the sample microfocusing plate contains many marked sample region, so called as a sampling area 211. The sample support holder has a surface to accept the sample microfocusing plate, and at least a magnet to attach the sample microfocusing plate to the surface. Thus sample microfocusing plate can be attached to the surface of the sample support holder, and more preferably the sample microfocusing plate can slide and attach to the sample support holder by magnetic force. The sample microfocusing plate is positioned on the surface by protruding guides of the sample support holder.

One or more sample microfocusing plate can be positioned on the surface of a sample support holder.

Referring to FIGS. 3A and 3B, a sample microfocusing plate includes a substrate 100, the marked sampling area 120 formed on the substrate 100, and a hydrophobic coating layer 140*a* formed on the substrate 100 to partially cover the marked sampling area 120.

One or more samples to be analyzed may be positioned on the sampling area 120. The hydrophobic coating layer 140*a* has openings that selectively expose the central surfaces of the marked sampling area 120.

Substrate

Materials of suitable electrically conductive substrates include a stainless steel, aluminum, zinc, or copper, and preferably stainless steel. In addition, plastics or other non-conductive materials, coated with a layer of metal to maintain electrical conductivity properties, can also be used.

The aluminum or stainless steel (SUS) substrate is relatively thin and can be easily manufactured at low cost. The aluminum substrate may be efficiently recycled for the sample microfocusing plate or any other uses. Generally, a stable natural oxide film can be formed on the aluminum or SUS substrate exposed to air. The aluminum or SUS substrate is moisture proof to prevent degradation under high temperature and humidity.

In the case of the copper substrate, however, an irregular oxide film may be formed on the surface thereby corrode the substrate. A red iron oxide film can easily be formed on a steel substrate under high humidity. Since the natural oxide film formed on the aluminum or SUS substrate can have a stable and dense structure, the surface of the aluminum or SUS substrate has improved characteristics, where contaminants not attach to the surface during sample analysis. Additionally, the sample to be analyzed does not react with the surface of the aluminum or SUS substrate allowing the sample microfocusing plate to safely keep the sample for a long time. Furthermore, the efficiency of the laser irradiated onto the sample microfocusing plate during sample analysis is improved because the aluminum or SUS substrate has a relatively high light reflectivity.

The substrates of sample microfocusing plate may have a thickness ranging from 0.05 mm to 2.0 mm, and preferably about 0.1 mm to 0.5 mm. When the substrate thickness is below the range, the substrate may be easily bent or ruptured. On the other hand, when the thickness of substrate exceeds the range, it is difficult to perform the photoetching process with time consuming. Additionally, the substrate may be heavy enough to require an additional supporting element.

Preferably, the marked sampling area 120, so called pattern, is arranged on the substrate 100 by identical intervals. Patterns 120 may be arranged in a matrix shape. Each of the patterns 120 has an upper face on which the sample is positioned. The sampling area can be prepared by photolithography and etching. The sampling area has a circular shape, a rectangular shape, a triangle shape or grid shape.

The pattern surfaces 120 may have diameters of 1.0 mm to 5.0 mm in order to visually identify positions where samples are dropped and to allow sufficient area for samples to be condensed on their surfaces 120. Preferably, each of the upper faces of the patterns 120 may have a diameter of 1.0 mm to 3.0 mm.

Hydrophobic Coating Layer

The hydrophobic coating layer 140*a* is formed on the substrate 100 to cover the sampling area 120 except for the central portion of its surface 120. The hydrophobic coating layer 140*a* enables the substrate 100 to have hydrophobic properties, thereby reducing the contact area between the sample and the marked sampling area 120.

The hydrophobic coating layer 140*a* includes openings D in the central portion of the marked sampling area that expose the central surfaces of the patterns 120. The openings D of the hydrophobic coating layer 140*a* partially expose the upper portions of the patterns 120 in a way that allows for exact positioning of samples on the pattern surface 120. Because the openings D of the hydrophobic coating layer 140*a* selectively expose the central upper surface of the pattern 120, the sample may be precisely positioned on the sampling area surfaces 120 and then condensed after the solvent in the sample is evaporated.

The conductivity of the thin film of hydrophobic organosilane coating is sufficiently high to permit dissipation of surface charges and the avoidance of accumulated static charges in the surface. As a result, the coated sample microfocusing plates exhibit the same stability of signal versus the number of laser shots and the same resolution as is observed for standard untreated metal MALDI plates for both MS and MS/MS analytical processes. Because of the higher hydrophobicity of the hydrophobic coating layer as compared to the substrate surface, liquid handling is improved in that more liquid spots can be applied to the coated sample microfocusing plate as compared to the number of spots that can be applied to the customary sample microfocusing plate with its less hydrophobic substrate surface.

A sample microfocusing plate having a hydrophobic coating may also be conveniently kept in sealed state for reducing the contamination for further confirmation of the sample. For best results, the coating applied should be a thin film, essentially a monolayer.

The hydrophobic thin film has a thickness of about 5 nm to about 50 nm. The thin monolayer type hydrophobic coating is enough for giving the difference for microfocusing of sample on the sample microfocusing plate and eligible for the photolithographic process for making uncovered spot position. If the coating film is too thick, it will be difficult to remove the photoresist film after hydrophobic coating.

The thin film is a monolayer of hydrophobic organosilane. The thin film is made from at least one selected from the group consisting of cycloperfluorocarbon polymer, alkanesilane, and fluorosilanes.

The covalent bonding of organosilane with surface hydroxide on substrate is well known process. In the present invention, after developing hydroxide layer on stainless steel (SUS), the covalent bonding of organosilane on SUS was prepared. The hydrophobic coating measured by contact angle measurement (117 degree) was sustained with the stability test with strong acid (0.1M HCl for 5 min) and strong base (0.1M NaOH for 5 min) as well as the sonication with organic solvents such as acetone, methanol, and ethanol. This proves the indirect characteristics of covalent bonding of organosilane on SUS.

The hydrophobic coating layer 140 is a thin film of monolayered hydrophobic organosilane may include alkanesilane and fluorosilanes such as fluoroalkyl monosilane, perfluorodisilane or perfluoroethylpolysilane.

For example, the silane solution is formed by dissolving paraffin in a solvent such as hexane, heptane, octane, acetone or a mixture thereof. Suitable concentrations of silane in solution to create the desired hydrophobic surface are between about 0.01% and about 1% (v/v). After application of the silane solution, the solvent on the plate is evaporated either at room temperature or at an elevated temperature, for example from about 20° C. to about 120° C. until the solvent is completely evaporated to leave a thin film of silane having a thickness between about 5 nm and about 50 nm. When the substrate to be coated has a smooth mirror finish, the substrate surface is entirely and integrally coated with the organosilane. The resultant surface is hydrophobic and is capable of dissipating a static charge.

The hydrophobic coating layer 140 has a thickness of about 5 nm to about 50 nm. If the hydrophobic coating layer 140 has a thickness below 5 nm, the hydrophobic coating layer 140 may have poor hydrophobic properties and become vulnerable to surface scratches. If the hydrophobic coating layer 140 has a thickness above 50 nm, the openings D through the film may not form accurately.

The openings D are formed through the hydrophobic coating layer 140 in order to partially expose the patterns 120. The openings D may have dimensions that vary according to the kind of and amount of sample. Specifically, each of the openings D may have a diameter ranging from 100 μm to 1000 μm since the opening D diameter is larger than the wavelength of laser employed for analyzing the sample.

The sample microfocusing plate can be manufactured at a considerably lower cost and considerably faster than conventional MALDI plates. Additionally, the solvent contained in the samples can be evaporated faster on sample microfocusing plate compared with conventional MALDI plates. Furthermore, the sample microfocusing plate provides improved sensitivity and enhanced resolution of the sample, thereby allowing for the acquisition of excellent data.

The photolithographic patterning process is applied on substrate surface directly, and thus many plates are treated simultaneously to make it possible to produce MALDI sample plate in large scale with a low cost. Hydrophobic organosilane coating which covalently binds to the substrate surface can be easily prepared by dipping the substrate into the coating solution in a short reaction time. In addition, the covalent coating provides the homogeneous surface on the substrate. The thin film of the mono-layered organosilane is stable chemically and physically. Therefore, the organosilane coating can be suitable for disposable type or sample conservation type of MALDI sample plate.

Methods for Manufacturing the Sample Microfocusing Plate

Figure 4A:
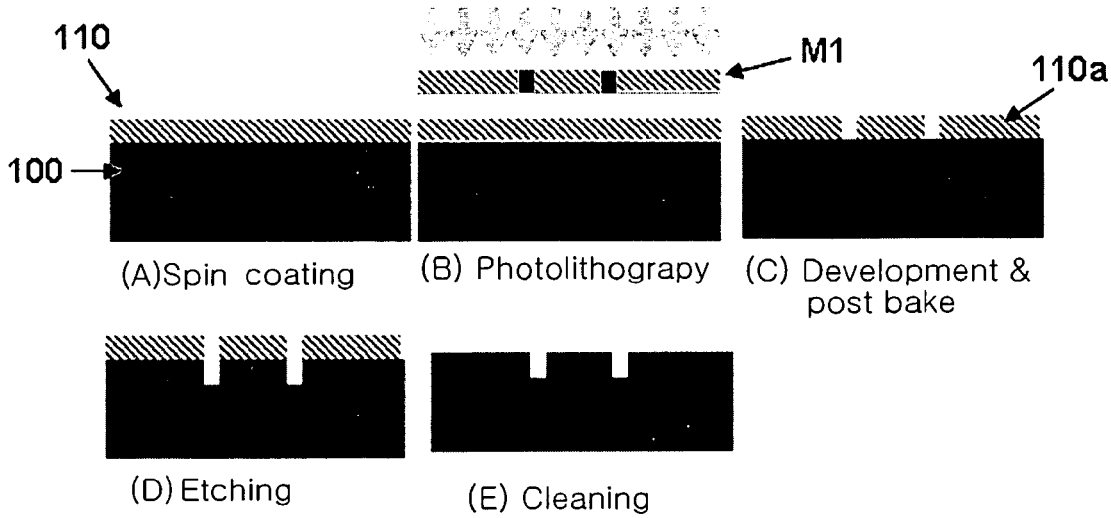
FIGS. 4A to 4B are cross-sectional views illustrating the method of manufacturing the sample microfocusing plate in accordance with the description of the present invention.
Figure 4B:
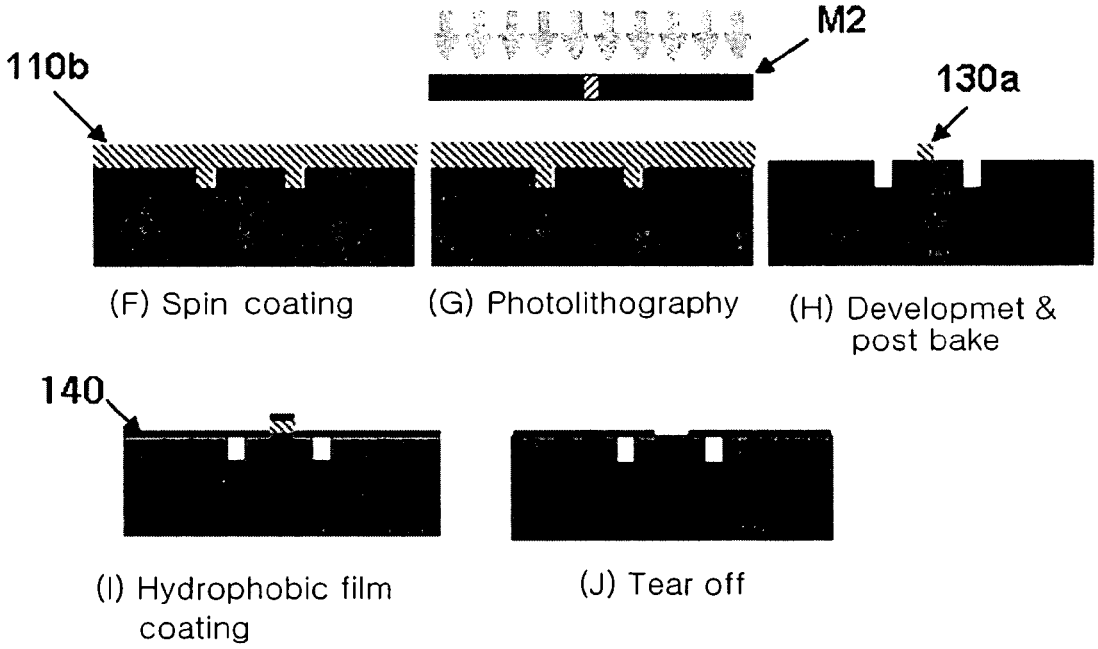

FIGS. 4A to 4B show cross-sectional views illustrating the method of manufacturing a sample microfocusing plate according to the description contained herein.

FIG. 4A illustrates a substrate 100 to be used in the manufacture of the sample microfocusing plate. The substrate 100 is preferably made of aluminum or SUS on which the surface treatment process is performed.

During the surface treatment process, organic impurities and dust existing on the surface of the substrate 100 are removed from by cleaning process using ultrasonic waves (i.e., an ultrasonic cleaning process) and/or a second cleaning process using acid (i.e., an acid cleaning process). After surface treatment the uniformity of the substrate 100 is improved and the adhesion strength between substrate and the photoresist film is going to be enhanced. More preferably the surface of the substrate is cleaned and oxidized by chemical or physical treatment that is carried out by acid solution such as phosphoric acid or plasma treatment in order to efficiently form the thin film of mono-layered hydrophobic organosilane.

The photolithography and etching processes which have known to the semiconductor manufacturing field can be applied to the present invention. The first photoresist pattern and the second photoresist pattern are formed by photolithography after photoresist coating. The first photoresist pattern and the second photoresist pattern are made from same or different material.

The first photoresist film 110 was formed on the substrate 100 by coating process. The thickness of this film can range from 0.5 μm to 100 μm in FIG. 4A. The spin coating method of photoresist film can be carried out, but not limited thereto. The substrate 100 with the first photoresist film 110*a* is then soft baked for about 1 minute to evaporate the solvent contained in the film 110. A photo mask (M1) is positioned over the first photoresist film 110 to selectively expose the film to irradiating lights as indicated by arrows in FIG. 4A. FIG. 4A shows the first photoresist pattern 110*a* on the substrate 100 after the photoresist film 110 is baked, developed and cleaned. In the post-exposure baking process, acid ingredients generated in the first photoresist film 110 are amplified to provide the film 110 with selective solubility. The post-exposure baking process is formed at a temperature of about 100° C. to about 130° C. for about 1 minute. Patterns 120 are formed by opening portions of first photoresist film 110*a* on the substrate 100. The substrate 100 is partially etched using the photoresist pattern 110*a* as an etching mask with acid.

The first photoresist pattern 110*a* is removed by stripping and/or ashing from the substrate 100. The patterns 120 have upper surfaces where the samples to be analyzed are placed. In the sample microfocusing plate, the patterns 120 are arranged on the substrate 100 by identical intervals. As an example, the patterns 120 may be arranged on the substrate 100 in a matrix shape.

In FIG. 4B, second photoresist patterns 130*a* are formed on the center of the initial pattern's 120 upper surfaces by another photolithography process. The formation of the hydrophobic coating layer in step d) comprises the steps of uniformly and integrally coating a hydrophobic material on the substrate; and removing the second photoresist pattern formed on the central portion and the hydrophobic material positioned on the second photoresist pattern.

A second photoresist film is formed on the substrate 100 to cover the patterns 120. The second photoresist film can be formed by a spin coating process. The second photoresist film can have a thickness of 0.5 μm to 100 μm, but preferably between 0.5 μm and 50 μm. The substrate 100 having the second photoresist film is then soft baked for about 1 minute to evaporate the solvent included in film. The second photoresist film is selectively exposed to light by a second photo mask (M2). The exposed second photoresist film is then baked (i.e., a post-exposure baking process), developed and cleaned in order to form the second photoresist patterns 130*a* on the center of the initial pattern's 120 surfaces. Each of the second photoresist patterns 130*a* can have widths of 100 μm to 1 mm. These second patterns 130*a* will form the opening through which the first pattern's surfaces will be exposed and where the sample is condensed.

The hydrophobic coating layer 140 is formed on the substrate 100 and on the second photoresist patterns 130*a* which cover the initial patterns 120. The central upper faces of the patterns 120 are not covered with the hydrophobic film 140 because the second photoresist patterns 130*a* are located thereon.

Since the second photoresist patterns 130*a* are formed on the center portion of the pattern surfaces 120, the hydrophobic coating layer 140 is uniformly coated throughout the substrate 100, the second photoresist patterns 130*a* and the patterns 120. When the second photoresist patterns 130*a* are removed, the central portion of the pattern surface 120 is open while the other surface is covered with the hydrophobic film 140, thereby completing the sample microfocusing plate. The second photoresist patterns 130*a* can be removed from the patterns 120 by ashing and/or stripping process. The openings have diameters that are identical to those of the second photoresist patterns 130*a*, which can range from 100 μm to 1,000 μm. The sample can condense in the center of the pattern's surface 120 after the solvent included in the sample is evaporated. Furthermore, the sample can be precisely positioned at the center of the pattern's surface through the openings on the hydrophobic film 140.

According to the method described above, a number of the sample microfocusing plate can be easily manufactured because of use of photolithography. Finally, the sample microfocusing plate can be produced at a much lower cost and faster than conventional method.

In addition, the sample microfocusing plate can rapidly dry the solvent contained in samples leading to efficient sample analysis. According to the present invention, several sample microfocusing plates can be manufactured simultaneously by photolithography without laser etching. Additionally, the sample microfocusing plate can have precisely controlled dimensions for accurate sampling. Therefore, the sample microfocusing plate can be employed in either quantitative or qualitative analyses.

Surfaces of plates cleaned by this approach can be regenerated between 50 and 100 times or more without affecting the quality of the mass spectrometric measurements.

Sample Support Holder

The sample support holder has protruding guides for positioning the sample microfocusing plate on the surface, which are located at at least one selected from the group consisting of a pair of two opposite peripheral sides of the surface, two pairs of two opposite peripheral sides of the surface, and space between the sample microfocusing plates.

The sample support holder comprises at least a layer of electrically conductive substrate where the magnet is inserted thereto. Preferably, the sample support holder can be made by stainless steel (SUS), aluminum, zinc, or copper. If the sample support holder is comprised of three layers of stainless steel sheet, the magnets are inserted into the central sheet through a hole.

The magnetic sample support holder is made by photolithographic patterning, chemical etching of SUS plates (1 mm-2 mm depending on the vender's model) and mechanic machining of them to insert the magnet 223 in it.

Figure 9C:
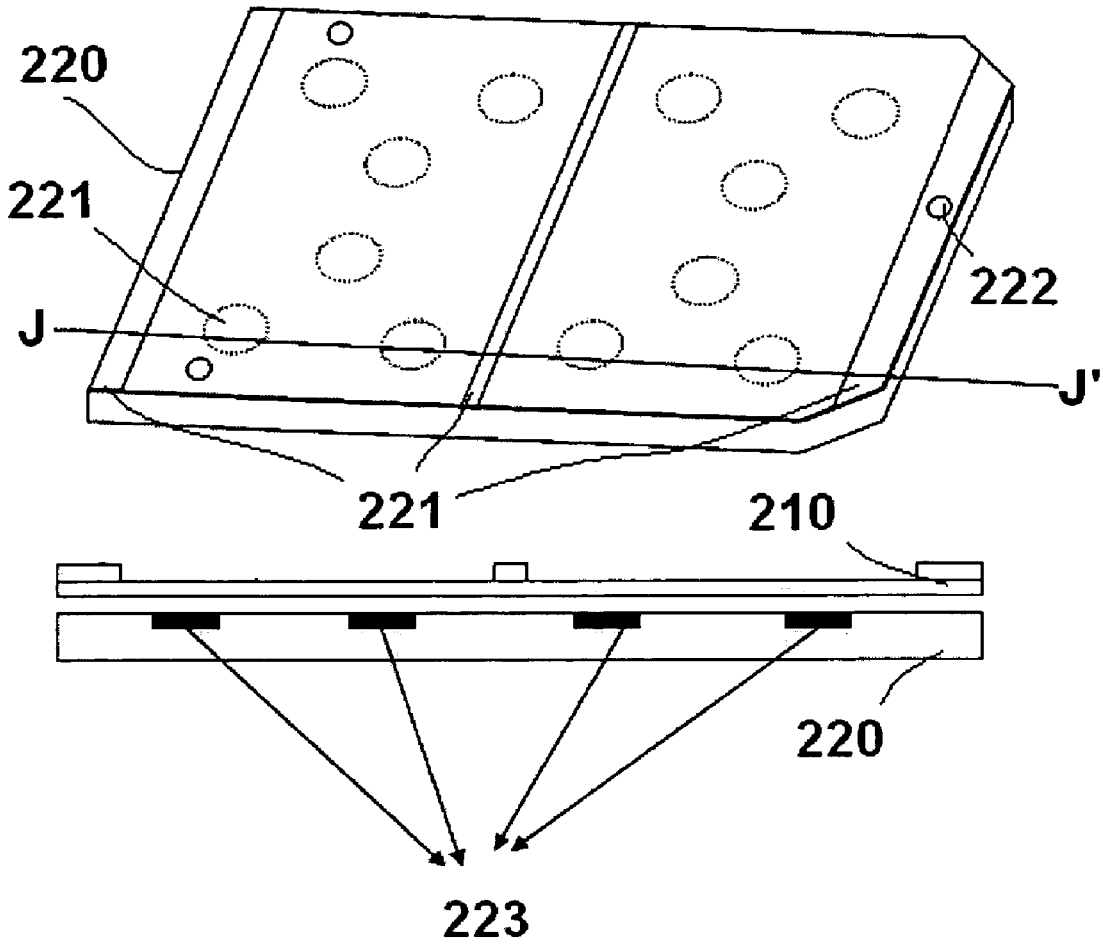

FIG. 9A to 9C show the sample support holder. FIG. 9A to 9C are a photograph and a perspective view illustrating the sample plate 200 composed of the sample microfocusing 210 and the sample support holder 220 in accordance with the description of the present invention. FIG. 9C is a cross-sectional view illustrating the sample support holder taken along a line of J-J'. The sample support holder 220 includes at least an inserted magnet 223, frame docketing holes 222, and protruding guides for positioning the sample microfocusing plate on the surface, which are located at a pair of two opposite sides of the surface of the sample support holder. The protruding guides are located at a pair of two opposite sides, or two pair of two opposite sides of the sample support holder. If two or more sample microfocusing plates are used in a sample support holder, the protruding guides are the portion between the positions of two or more sample microfocusing plates, as well as the in the peripheral side of the support holder. For example, when two microfocusing plates are used in a sample support holder, the protruding guides are located at a pair of two opposite peripheral sides, and central portion.

Referring to FIGS. 9B and 9C, the sample microfocusing plate, which the sample loaded on the sampling area 211, is adjusted to the peripheral side of the protruding guides in the sample support holder, and slided to the surface of the sample support holder, so as to positioning the microfocusing plate 210 on the sample support holder 220 correctly. Due to the magnetic force, the sample microfocusing plate and sample support holder can be treated with in a single body.

The sample support holder comprises at least a layer, for example three layers. If the three layers of sheets are stacked to produce the sample support holder, the magnet can be inserted to the central sheet preferably.

The sample support holder can be made by photolithographic patterning, chemical etching of plate which has different thickness and size depending on the vender's model, and then mechanical machining to insert the magnet in it.

The present invention is further explained in more detail with reference to the following examples. These examples, however, should not be interpreted as limiting the scope of the present invention in any manner.

EXAMPLE 1

Manufacturing of Sample Microfocusing Plate

A. Manufacture of Sample Microfocusing Plate

A sample microfocusing plate with several pattern and microfocusing function has been fabricated as follow.

A stainless steel 430 sheet with 400×500 mm, and 0.2 mm thickness was used as a substrate. The sheet was pre-cleaned with 0.1 M HCl or 0.05M HF solution for the better adsorption with photoresist films. Poly(methyl methacrylate (PMMA) film with 0.1 mm thickness (Riston® photopolymer dry films (Dupont)) was used as a photoresist film. $FeCl_3$ solution was used as etching solution for the surface.

The photoresist film was pressed on the SUS sheet at 150° C. for bonding. The film was developed by using a photomask and a UV light, and then baked at 150° C. The opened part of the surface which was going to be a surface marking (the circles in FIG. 2A or the letters) was etched with etching solution until the color was changed to white. After the etching, the remained photoresist film was removed by acetone with sonication for 5 min. This made the surface marking which in FIG. 2A.

Figure 4C:
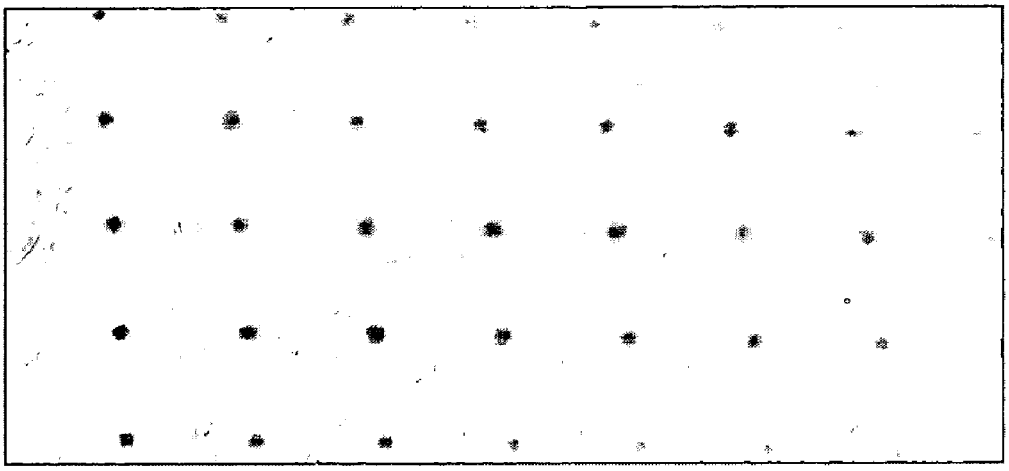
FIG. 4C and FIG. 4D are pictures of plates which are obtained in Step (H) and Step (J) shown in FIG. 4B, respectively.
Figure 4D:
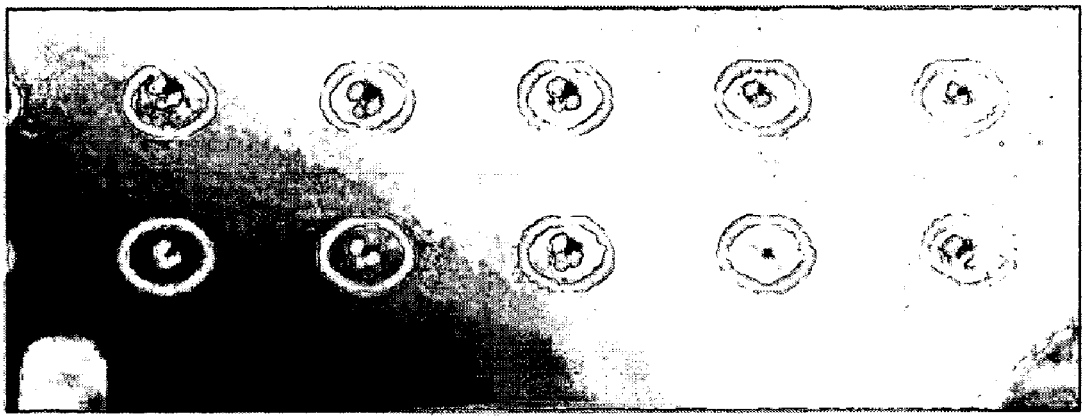

The second photolithographic process was applied with same experimental condition on the first one with different mask for making the opened hydrophilic sample spot in the center of the marked region. The exact alignment of the $2^{nd}$ photomask on the substrate is important and align marks are used for this purpose. After development and baking, the substrate (substrate A) with photoresist covering in central portion as shown in FIG. 4C.

The hydrophobic surface of the plate was made by covalent bonding of fluorosilane with substrate surface. 0.3 percent of 20 mM perfluorotrichlorosilane copolymer solution (BP=84° C., Optool solution, Daikin), or 3M fluorocarbon solution FC-3283 were used as hydrophobic organosilane. Silane reaction with hydroxide surface is well known to form covalent bonding. After cleaning the surface by dipping in etching solution for 1 min and washing by deionized (DI) water, the initial hydrophobic coating was formed by dipping the substrate for 30 seconds.

The hydrophobic coating of the surface was examined by water contact angle. The increase of the contact angle can be recognized easily just by visual inspection and the measured contact angle was 117.22 degree after baking process at 120° C. for 30 min to form a hydrophobic coating layer. The remained photoresist film in the center part was removed by using ethanol solution and this spot became hydrophilic.

The hydrophilic characteristics on small spot of the sample microfocusing plate were checked by dipping the plate in DI water. The result was shown in FIG. 2A. These methods give high throughput and reproducibility of pattern because several plates can be made at once by using large substrate with highly accurate photolithographic process.

B. Manufacture of Sample Support Holder.

Three stainless steel substrate (SUS) 304 having 1 mm, 1.5 mm, 2 mm thickness 200 mm×300 mm sheet for sample support holder. The sample support holder can be made by photolithographic patterning, chemical etching of plate which has different thickness and size depending on the vender's model, and then mechanical machining to insert the magnet in it.

EXAMPLE 2

Contact Angle Measurement on Hydrophobic Surface

The contact angle of the sample microfocusing plate obtained in Example 1 was measured by Phoenix 300 contact angle analyzer (S.E.O, Korea) with D. I. water after hydrophobic coating with fluorosilane coupling reagent and compared with the ones before coating, which included bare and clean substrates.

Figure 2B:
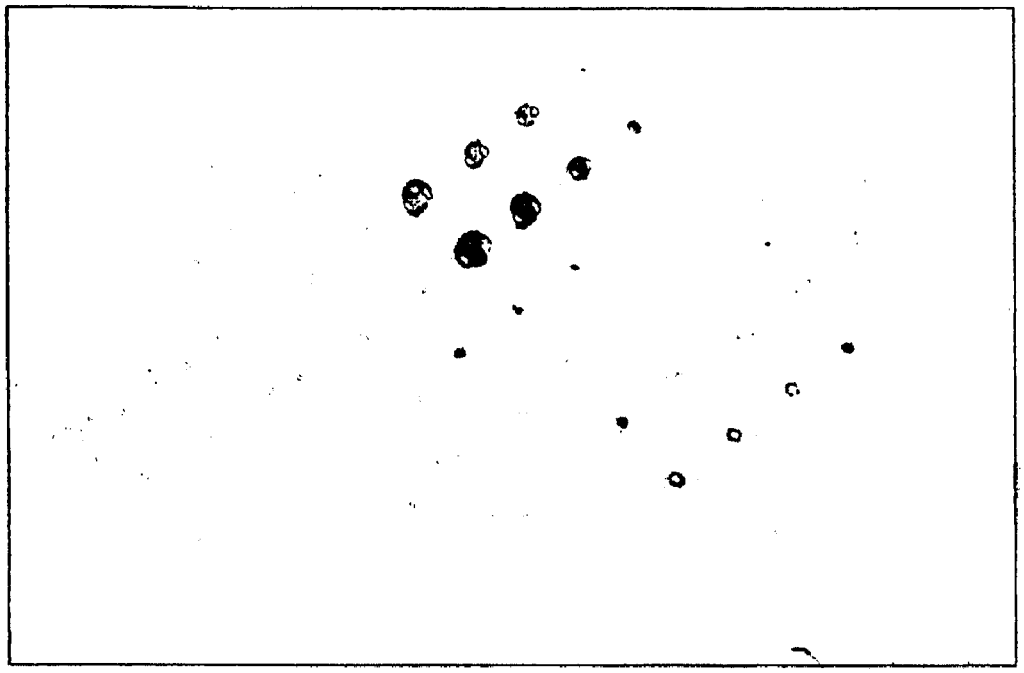
Figure 5A:
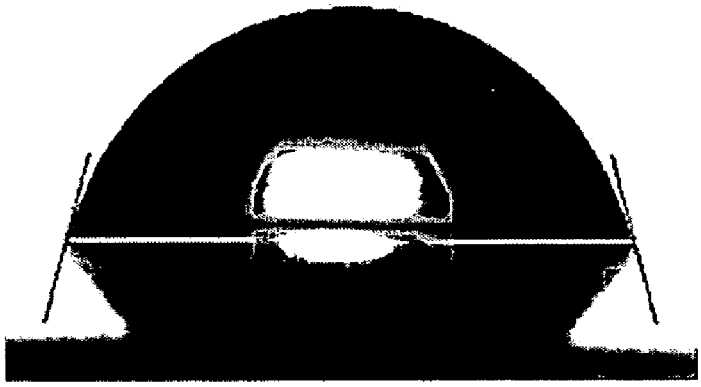
FIG. 5A to 5C show the comparisons of water contact angles of uncoated stainless steel substrate (5A), substrate by cleansing treatment (5B), and hydrophobic coated surfaces by silane coupling reaction (5C).
Figure 5B:
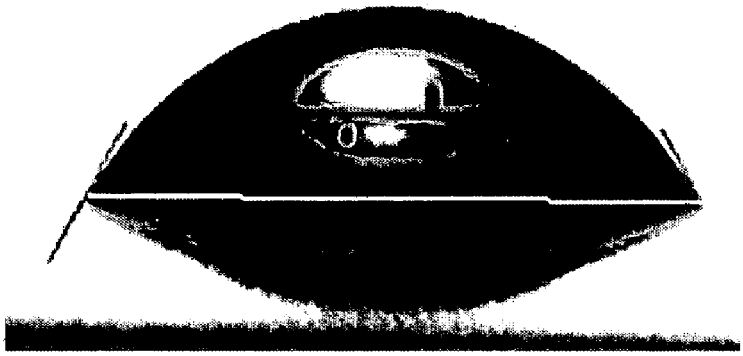
Figure 5C:
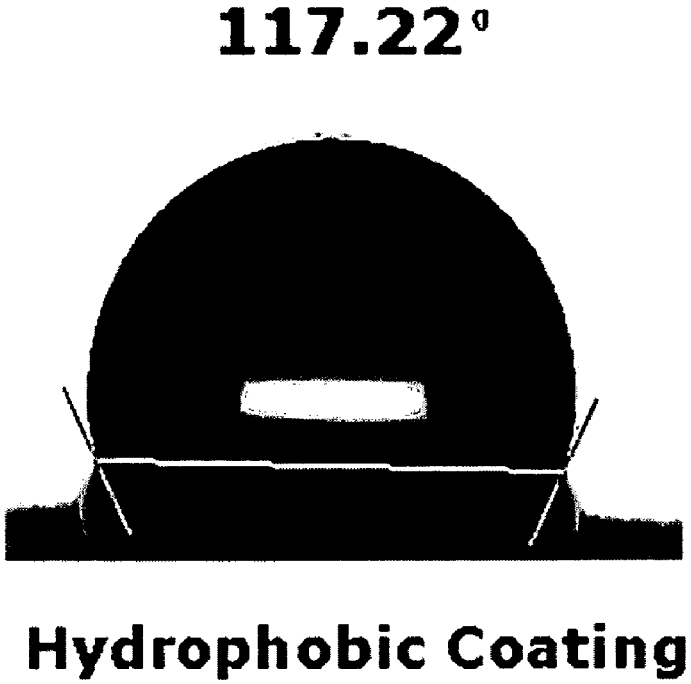

The results were in FIG. 5. Even if the thickness of coating is less than 50 nm, the measured contact angle with D. I. water was 117.22°. This is more hydrophobic than most of polymers or metal surfaces. It can be compared with the surfaces before any treatment and after cleaning with acid solution. The bare surface has higher contact angles at 72.48 than the acid cleaned one at 53.22. However, the large difference in contact angles between the hydrophobic coated surface and the others represents microfocusing characteristics of the sample microfocusing plates. Microfocusing of water on the coated sample plate was shown in FIGS. 2A and 2B. FIG. 2B was colored with water soluble dye and could show the dried spots on the plate.

EXAMPLE 3

Spot Shapes on Sample Plate

Figure 6A:
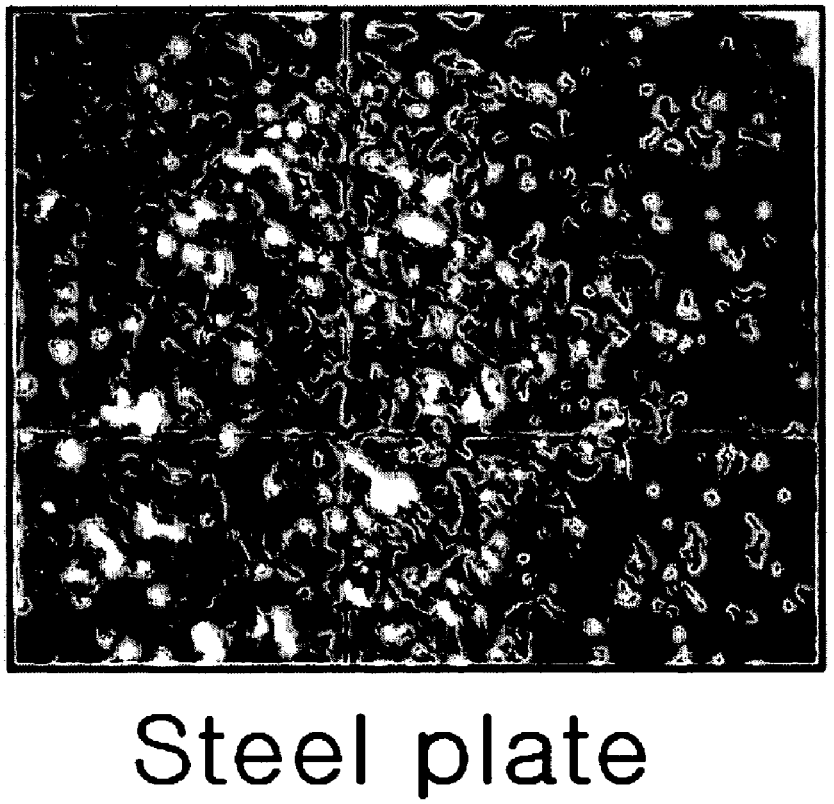
FIGS. 6A, 6B and 6C depict the matrix spots which are deposited on A) steel plate, B) Anchorchip and C) the sample microfocusing plate of the present invention, respectively.
Figure 6B:
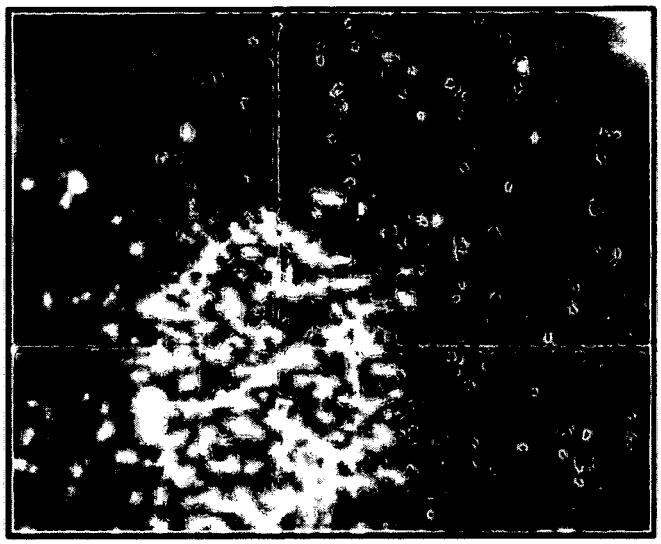
Figure 6C:
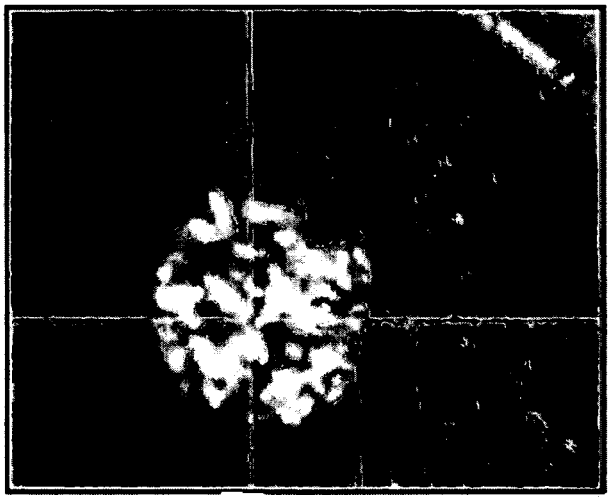

A matrix employed for analyzing the samples included alpha-cyano-4-hydroxycinnamic acid (CHCA). The spots of CHCA matrix which was deposited on stainless steel plate, conventional Anchor chip plate, or sample microfocusing plate of the present invention obtained in Example 1 were compared in FIGS. 6A, 6B, and 6C.

The smooth surface of the microfocusing plate is easier to recognize the focused sample spot even though the focusing action is similar on Anchorchip and sample microfocusing plate. Moreover, because of the thickness of the film, the sample was dried faster on the sample microfocusing plates.

EXAMPLE 4

MALDI Spectrum of Standard Peptides

Figure 7A:
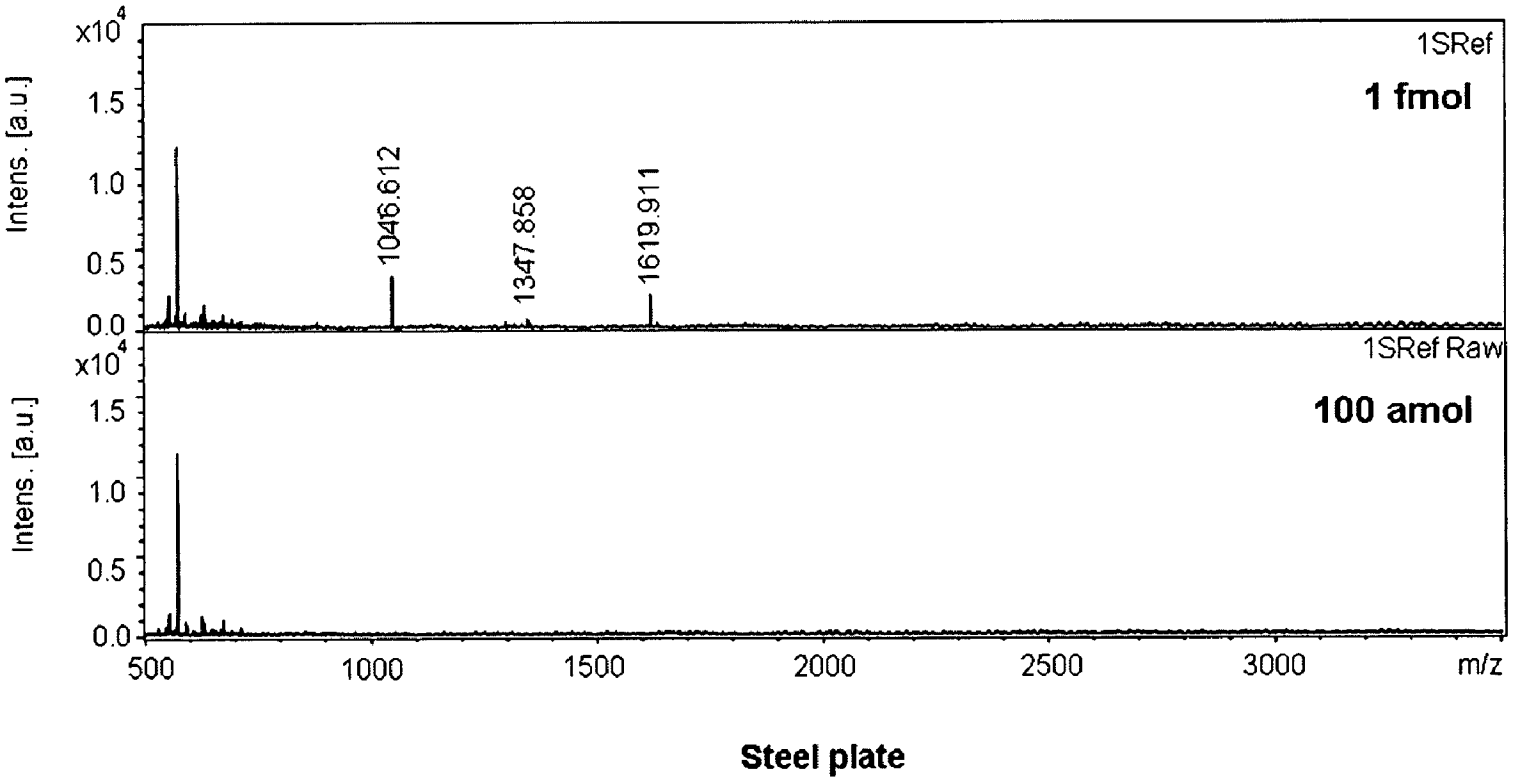
FIG. 7A to 7C are MALDI mass spectra collected by analysis of peptide mixtures (angiotensin II[M+H], angiotensin I[M+H], substance P[M+H], bombesin[M+H], ACTH clip(1-17)[M+H], ACTH clip(1-17)[M+H], and somatotatin [M+H]) on (A) Steel plate, (B) Anchorchip plate, and (C) Sample microfocusing plate by Bruker MALDI-TOF.
Figure 7B:
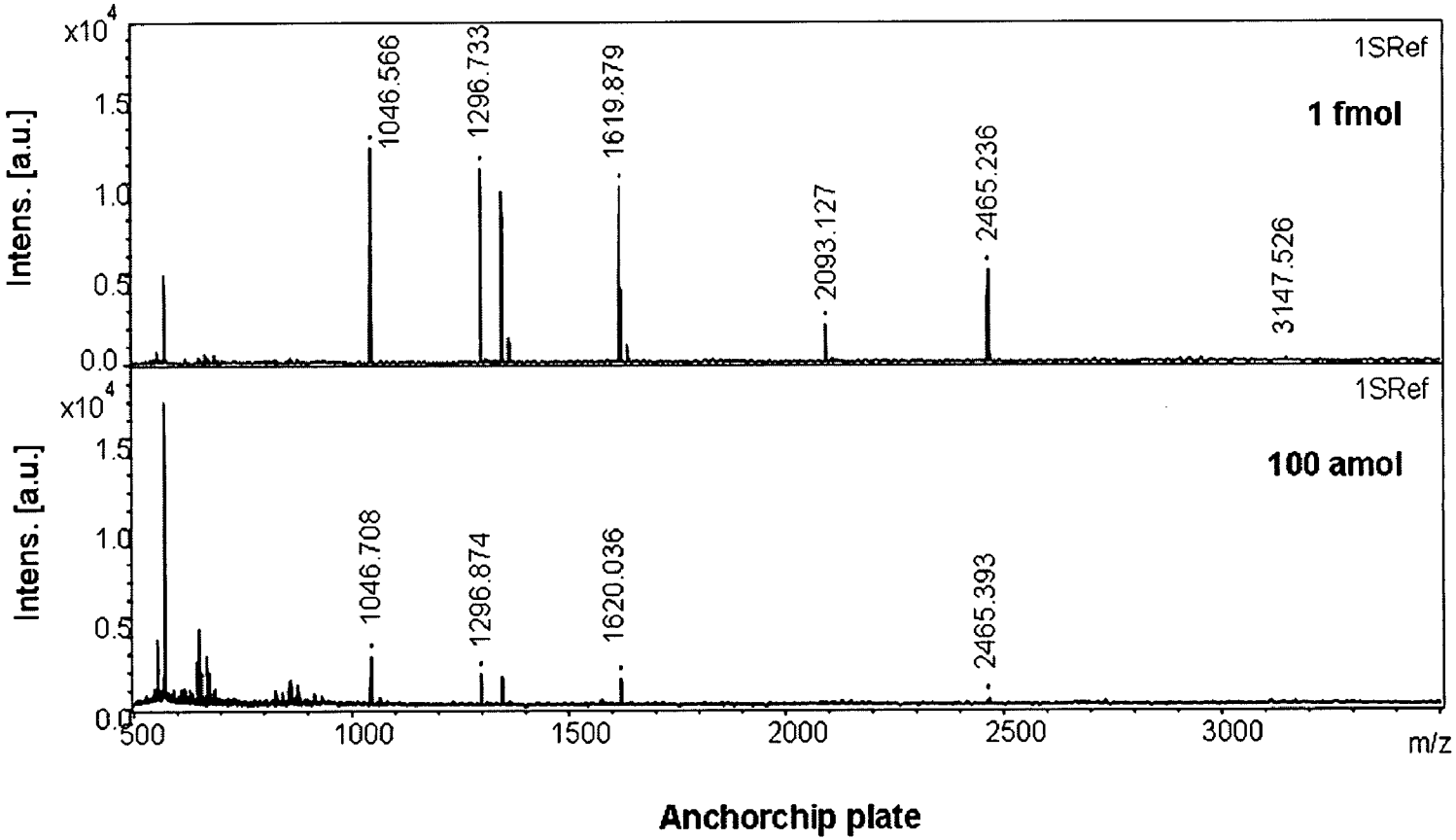
Figure 7C:
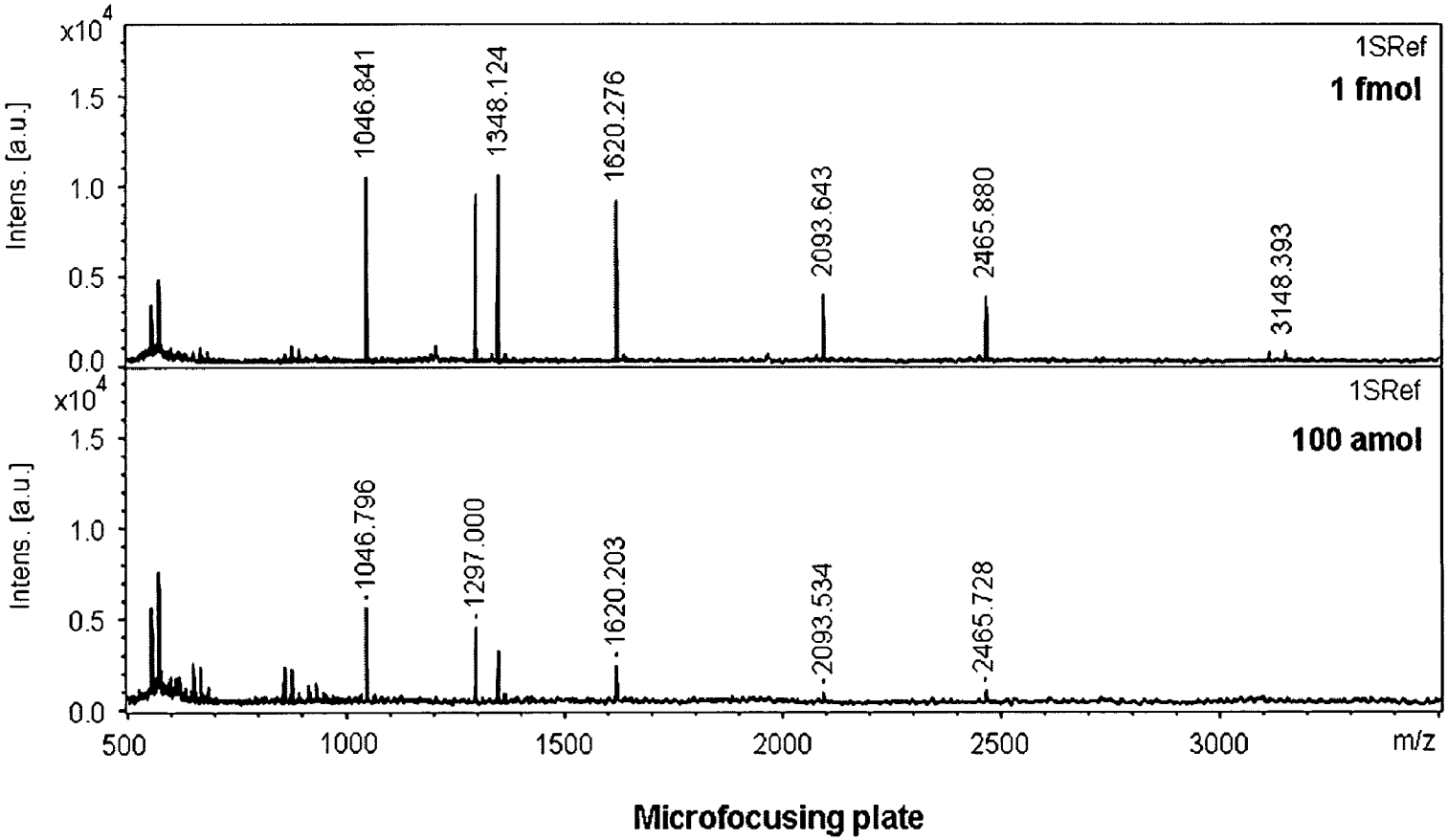

FIG. 7 is a MALDI spectra of six reference peptide samples analyzed using a sample microfocusing plate of EXAMPLE 1 as well as the sample plates from Brukers. Bruker Ultraflex MALDI-TOF system has been used for obtaining the spectra. The reference peptide samples were Angiotensin I, Angiotensin II, Substance P, Bombasin, ACTH (1-17), and ACTH (18-39). A matrix employed for analyzing the samples included alpha-cyano-4-hydroxycinnamic acid (CHCA).

As shown in FIGS. 7A and 7B, the six reference peptide samples were analyzed under high sensitivity relative to a reference peptide sample of 1 femto mole and 100 atto mole. 0.3 mg/ml CHCA was mixed with the standard reference peptide samples with 5 to 1 ratio. A nitrogen laser having a wavelength of 337 nm was also applied. The sample microfocusing plate efficiently condensed the samples and had higher sensitivity compared with the conventional Brukers MALDI steel plate for all peptide samples, and was compatible sensitivity with the Anchorchip.

EXAMPLE 5

MALDI Spectrum of Standard Proteins

Figure 8A:
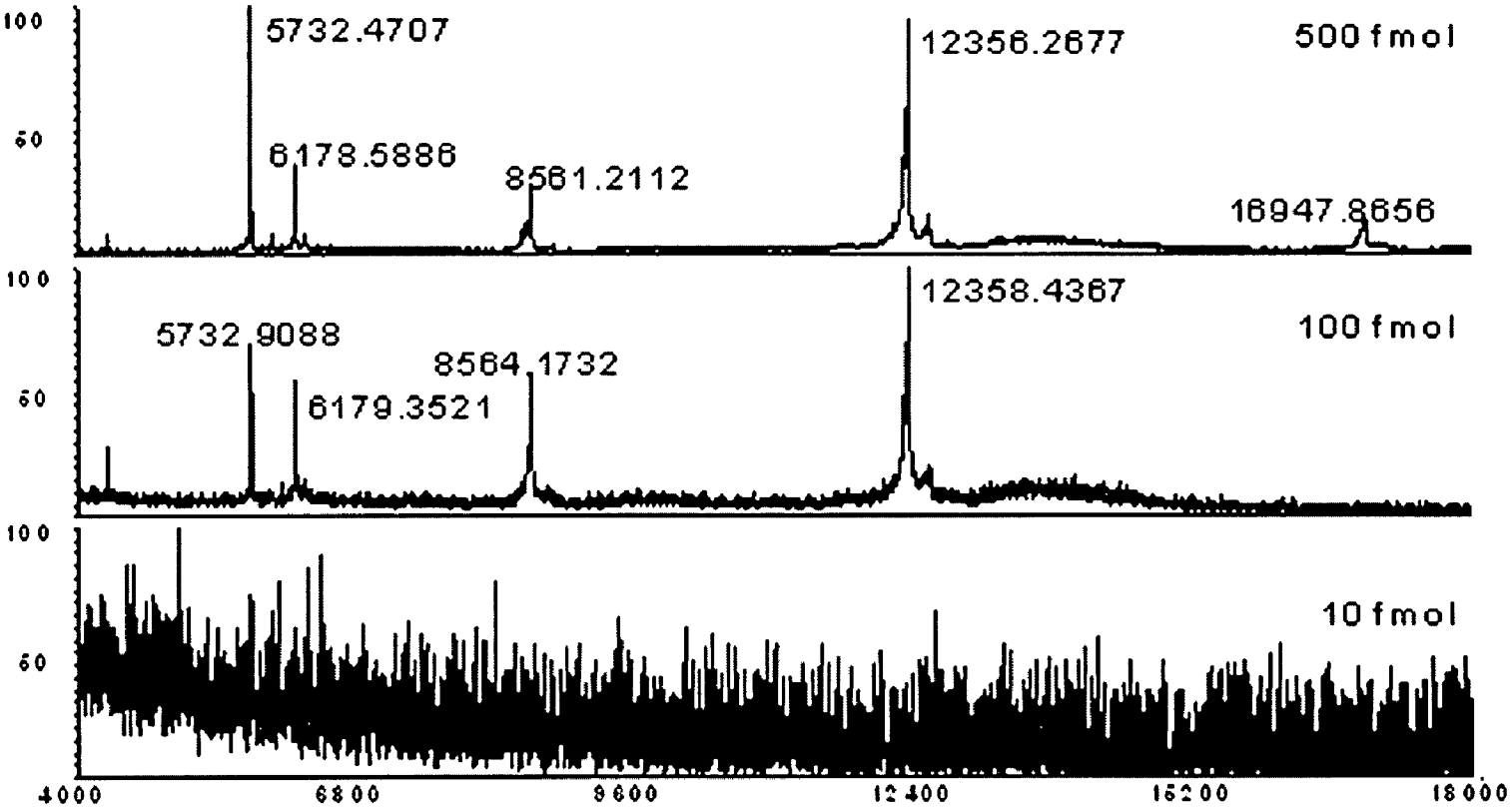
FIGS. 8A and 8B show the mass spectra of protein mixtures (insulin[M+H], cytochrome C [M+2H], myoglobin[M+2H], cytochrome C[M+H], and myoglobin[M+H]) on (A) ABI Steel plate, and (B) Sample microfocusing plate by Voyager MALDI-TOF.
Figure 8B:
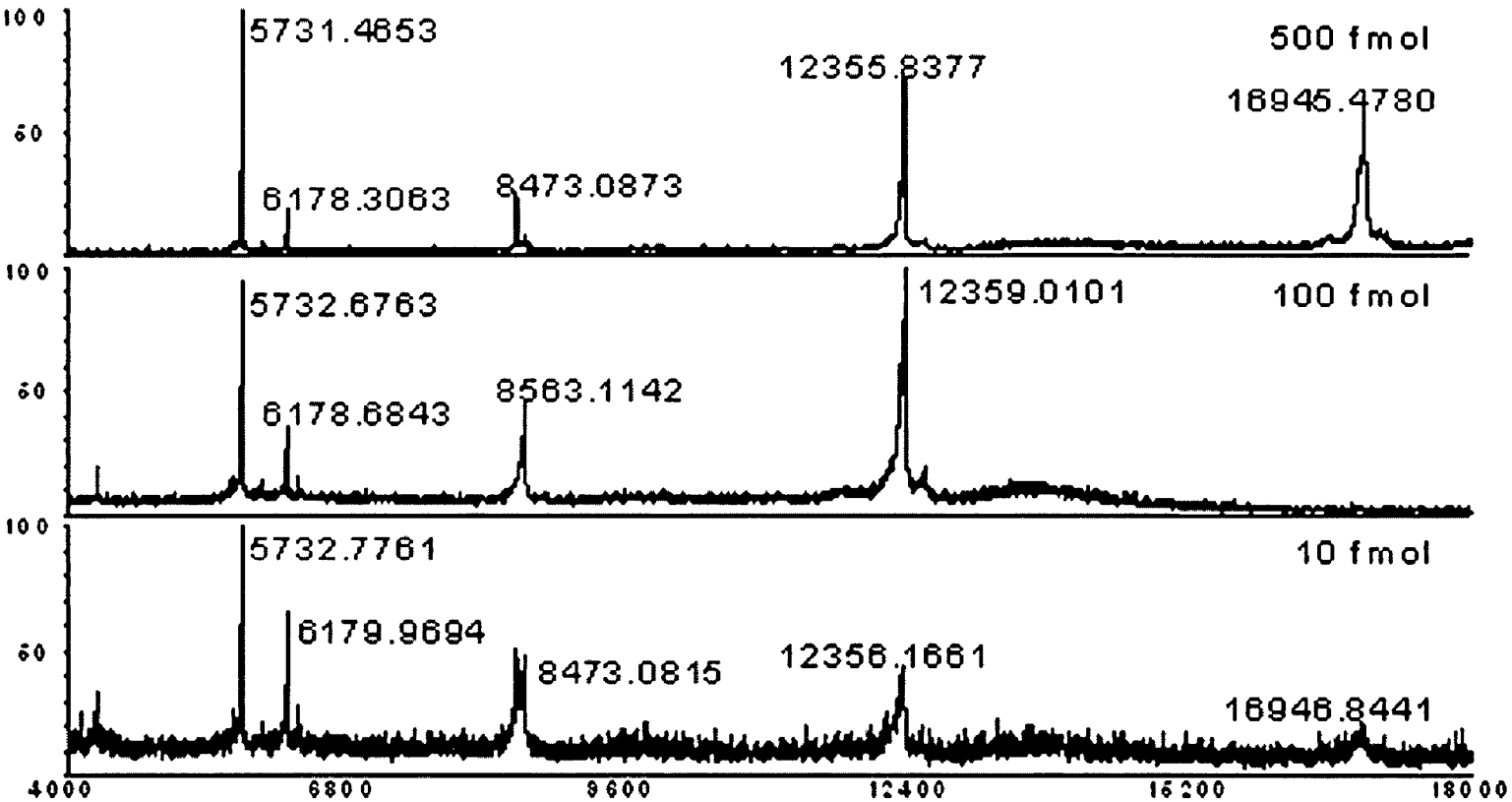

FIGS. 8A and 8B are the mass spectrum of protein mixtures (insulin[M+H], cytochrome C [M+2H], myoglobin[M+2H], cytochrome C[M+H], and myoglobin[M+H]) on (A) ABI steel plate, and (B) sample microfocusing plate by Voyager MALDI-TOF. Sample microfocusing plate for MALDI shows higher sensitivity at lower concentration at 10 femto mole of protein mixtures. The sensitivity of the sample microfocusing plate of the present invention shows 10 times as high as other sample plates.

What is claimed is:

1. A sample microfocusing plate for matrix-assisted laser desorption ionization (MALDI) mass spectrometry, comprising:

an electrically conductive stainless steel substrate having at least one hydrophilic smooth stainless steel surface;

at least one sampling area marked on the hydrophilic smooth stainless steel surface of the electrically conductive stainless steel substrate; and a substantially mono-layered hydrophobic organosilane formed on the hydrophilic smooth stainless steel surface through covalent bonding and having an opening to expose the hydrophilic smooth stainless steel surface at a central portion of the sampling area, wherein the sampling area comprises a hydrophilic central portion formed by the exposed hydrophilic smooth stainless steel surface and a hydrophobic peripheral portion formed by the mono-layered hydrophobic organosilane around the opening.

2. The sample microfocusing plate according to claim 1, wherein the hydrophilic central portion and the hydrophobic peripheral portion of the sampling area are formed by photolithography.

3. The sample microfocusing plate of claim 1, wherein the substantially mono-layered the hydrophobic organosilane has a thickness of about 5 nm to about 50 nm.

4. The sample microfocusing plate of claim 1, wherein the substantially mono-layered hydrophobic organosilane is made from at least one selected from the group consisting of alkanesilane and fluorosilane.

5. The sample microfocusing plate of claim 1, wherein the hydrophilic central portion has a diameter ranging from 100 μm to 1000 μm.

6. The sample microfocusing plate of claim 1, wherein the stainless steel substrate has a thickness of approximately 0.1 mm to 0.5 mm.

7. The sample microfocusing plate of claim 1, wherein the sampling area has a circular shape, a rectangular shape, a triangle shape or a grid shape.

8. A sample plate for matrix-assisted laser desorption ionization (MALDI) mass spectrometry comprising:

a sample microfocusing plate according to claim 1;

a sample support holder having a surface to accept the sample microfocusing plate; and at least one magnet to attach the sample microfocusing plate to the surface of the sample support holder.

9. The sample plate according to claim 8, wherein the sample support holder comprises a protruding guide positioning the sample microfocusing plate on the surface, and the protruding guide is disposed at opposite peripheral sides of the surface.

10. The sample plate according to claim 8, wherein the sample microfocusing plate slidably moves on the surface of the sample support holder.

11. The sample plate according to claim 8, wherein the magnet is disposed in a hole formed in the surface of the sample support holder or buried inside the sample support holder.

12. A method of preparing a sample microfocusing plate for matrix-assisted laser desorption ionization (MALDI) mass spectrometry comprising the steps of:

a) forming a hydroxide layer on a hydrophilic smooth stainless steel surface of an electrically conductive stainless steel substrate;

b) marking at least one sampling area on the hydrophilic smooth stainless steel surface on which the hydroxide layer is formed; and c) forming a substantially mono-layered hydrophobic organosilane on the hydrophilic smooth stainless steel surface so as to have an opening to expose the hydrophilic smooth stainless steel surface at a central portion of the sampling area, wherein the exposed hydrophilic smooth stainless steel surface forms a hydrophilic central portion of the sampling area, and the mono-layered hydrophobic organosilane around the opening forms a hydrophobic peripheral area of the sampling area.

13. The method of claim 12, wherein the step a) comprises the step of cleaning and oxidizing the hydrophilic smooth stainless steel surface of the stainless steel substrate through a chemical or physical treatment.

14. The method of claim 13, wherein the treatment is carried out by an acid solution or a plasma.

15. The method of claim 12, wherein the mono-layered hydrophobic organosilane is formed of at least one selected from the group consisting of alkanesilane and fluorosilane.

16. The method of claim 12, wherein the mono-layered hydrophobic organosilane has a thickness of about 5 nm to about 50 nm.

17. The method of claim 12, wherein the hydrophilic central portion has a diameter ranging from 100 μm to 1000 μm.

18. The method of claim 12, wherein the stainless steel substrate has a thickness of approximately 0.1 mm to 0.5 mm.

* * * * *

UNITED STATES PATENT AND TRADEMARK OFFICE

CERTIFICATE OF CORRECTION

PATENT NO. : 7,619,215 B2
APPLICATION NO. : 11/498557
DATED : November 17, 2009
INVENTOR(S) : Yangsun Kim It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 345 days.

Signed and Sealed this

Twenty-sixth Day of October, 2010

David J. Kappos

David J. Kappos
*Director of the United States Patent and Trademark Office*